US007441777B2

(12) United States Patent
Thompson

(10) Patent No.: US 7,441,777 B2
(45) Date of Patent: Oct. 28, 2008

(54) EDUCATIONAL QUESTION AND ANSWER ESCAPE GAME HAVING AN ANTAGONIST ELEMENT

(76) Inventor: Robert L. Thompson, 1538 N. Brooks Ave., Apt. 1, Fresno, CA (US) 93728

( * ) Notice: Subject to any disclaimer, the term of this patent is extended or adjusted under 35 U.S.C. 154(b) by 161 days.

(21) Appl. No.: 11/397,264

(22) Filed: Apr. 3, 2006

(65) Prior Publication Data

US 2007/0228660 A1 Oct. 4, 2007

(51) Int. Cl.
*G09B 19/22* (2006.01)

(52) U.S. Cl. ..... 273/243; 273/429

(58) Field of Classification Search ..... 273/429–431, 273/143, 263, 287, 243
See application file for complete search history.

(56) References Cited

U.S. PATENT DOCUMENTS 3,649,021 A * 3/1972 Hayes ..... 273/243
3,939,578 A 2/1976 Coffey
4,095,800 A 6/1978 Konsolas
4,696,477 A * 9/1987 Tsuzuki ..... 273/241
4,878,675 A 11/1989 Perry et al.
4,938,481 A 7/1990 Goldfarb et al.
5,121,928 A * 6/1992 Salerno-Sonneberg ..... 273/243
5,129,655 A * 7/1992 Gillespie et al. ..... 273/241
5,273,431 A * 12/1993 Charouhas ..... 434/129
6,267,376 B1 7/2001 Jenkins
6,322,076 B1 * 11/2001 Fikki ..... 273/278
6,669,196 B1 12/2003 Washko
6,752,396 B2 6/2004 Smith
6,761,358 B2 * 7/2004 Hallett ..... 273/430
6,886,831 B2 * 5/2005 Tolany et al. ..... 273/429
7,025,352 B2 * 4/2006 Bedford ..... 273/243
7,073,792 B2 * 7/2006 Esposito ..... 273/243

* cited by examiner

*Primary Examiner*—William M Pierce
(74) *Attorney, Agent, or Firm*—Richard A. Ryan

(57) ABSTRACT

An educational question and answer escape game combining the attributes of chance, knowledge and duel play to advance a player token from a start position to an end position along a game path. The game path has a plurality of interconnected path segments having a center section for movement along the game path and a ledge that defines a safety zone. The game has an antagonist element that moves on the game path to cause player tokens not on a safety zone to be redirected to the start position. A first chance mechanism controls the movement of the antagonist element along the center sections. The movement of a token along the center sections is controlled by a second chance mechanism. A token can be moved from the exposed center section to the safe zone by the player correctly answering a question or by operation of a third chance mechanism.

21 Claims, 4 Drawing Sheets

EDUCATIONAL QUESTION AND ANSWER ESCAPE GAME HAVING AN ANTAGONIST ELEMENT

CROSS-REFERENCE TO RELATED APPLICATIONS

None.

BACKGROUND OF THE INVENTION

A. Field of the Invention

The field of the present invention relates generally to games in which players advance tokens along a specified game path, typically on a surface such as a game board. In particular, the present invention relates to question and answer games in which correct answers to questions advance the position of a player's token along the game path and in which the player risks being sent back to the start of the path by an antagonist element or character. Even more particularly, the present invention relates to such games that are adaptable for use for entertainment, as an educational tool for self study, family interaction and for single or group play and in a board or electronic format.

B. Background

Board games have a long history and are known to have been played in most cultures and societies for many years, even predating the development of literacy in some of the earliest civilizations. To a certain extent, the popularity of board games is based on the high degree of entertainment that is derived from the social interaction which comes from the combination of competition and comradery which is intrinsic to the game play. In addition to, and perhaps because of the entertainment value inherent in game playing, board games are useful as a forum for the development of many types of social cohesion, from family unity to community building, by cultures and communities throughout the world. Another social attribute of many board games is the ability to be used as an educational tool. The various social and entertainment factors contributing to the historical success of board games also contribute to the board game being used as an effective teaching tool.

As is commonly known, board games are typically played on a game board that has a playing surface which is delineated by a closed path divided into more or less equally-sized areas, each of which can be occupied by one or more game pieces or tokens. A player moves his or her token as determined by specific rules that govern the actual moves that a player is permitted or prohibited from making and the occupancy of different areas of the game path and/or game board. For example, a player may be allowed to move a token to an adjacent area, but not one further away. In addition, the direction of the course of play, that is, the direction in which players move their tokens, is often restricted according to the rules or goals of the game. The factors governing how far a token is moved along the game path and what happens when a player's token lands on a particular part of the game path are often outside of the player's control. As is well known, chance or luck often dictates how a game is played within the structural context of the rules and, as such, forms the basis for how players move their tokens along the game path. For example, the throwing of dice, the spinning of a wheel or other chance mechanism that is segmented into numerical or other indicators, or the drawing of lots or other devices, such as playing cards that indicate varying incremental values or specific instructions, are sometimes used to randomize the allowable movements of the tokens.

There are many board games in which the game play is substantially based on knowledge or skills testing. In one common format, these board games require the players to demonstrate their knowledge of a given subject or topic area through a question and answer format in order to advance their game token along the specified game path. Question and answer or trivia games, based on this type of game format are very popular. Generally, such games focus on either a specific subject area or a group of inter-related knowledge-based topics such as science, geography or popular culture. One popular example of such games are the Trivial Pursuit® line of games from Horn Abbot Ltd, in which a circular game piece is moved along a game path according to the player's ability to correctly respond to questions directed to various trivia subjects, both broadly and narrowly. If the player answers the question correctly, he or she places a colored pie-shaped component in the game piece. A number of question and answer games have been patented. For example, U.S. Pat. No. 6,669,196 to Washko discloses a board game with tokens, game board and questionnaire cards wherein players advance through the game by testing their knowledge of public health topics. U.S. Pat. No. 6,267,376 to Jenkins discloses a trivia game that includes a game board having a plurality of linear playing paths and question and response cards that each have questions of differing levels of difficulty. Players select a level of difficulty and move their tokens along the path that corresponds to the chosen level of difficulty of the question cards. U.S. Pat. No. 3,939,578 to Coffey, discloses a board game used to study different educational subjects. The game includes game tokens, a series of interrelated game board units, and questionnaire cards that relate to the topics for study as assigned by the game. U.S. Pat. No. 4,095,800 to Konsala discloses a game apparatus comprising a game board having a map with a plurality of countries, each distinguishable from the others by color, for the study of geography.

Each of the aforementioned games contain various features and characteristics in the rules, game pieces, game board or method of play to distinguish that game from other games. Most of these games, as well as other similar games, are primarily predicated on chance and/or do not allow the player to demonstrate his or her knowledge of a wide range of topics. In addition, because many question and answer board games generally relate to a specific thematic focus that is predetermined by the subject of the game itself, they have the disadvantage of not being able to be easily amended or changed thematically to meet the desires or educational needs of its players. Board games wherein the players cast die, or primarily utilize other random means of determining how far one either advances or retreats through the course of the game, generally rely on chance or luck in order to win the game. In addition, the general format of many existing board games is designed for pre-set number of players, thus limiting the scope of both entertainment and potential educational benefit for a number of players outside of the parameters of the game. Frequently, though not usually the expressly intended purpose, board games that are based on a question and answer format which are tied to a specific subject matter can also be used as study tools to help players reinforce their knowledge in a given subject. The scope of many question and answer games that are currently available, however, is often limited to a relatively narrow range of competency within the given topic or subject area that defines the game.

Another relatively common type of game is one in which there is an antagonist feature or component that attempts to thwart the progress of one or more players along the specified game path. Typically, this type of game has a feature of the game board or a component directly associated with the game board that is configured to obstruct or inhibit the player's forward progress on the game path. The forward progress of a player's game token can be physically blocked by the antagonist feature, thereby preventing further movement of the token along the path, or the antagonist component can cause the player to have to move his or her token back to the beginning of the path or to a designated holding area on the game board. One example of such a feature is the "Go To Jail" space on the Monopoly® game board, which causes the player to be directed away from his or her normal forward movement to the "jail" area of the game board until he or she pays a fine, rolls a pair on the dice or makes a specified number of roll attempts. Another example of the use of an antagonist feature is the "Forbidden Bridge" game by Milton Bradley. In this game, the players tokens (representing explorer characters) move along a jungle path to obtain jewels and carry the jewels back to the start. Along the path, the token crosses a bridge that is configured to violently shake when the picture dice instructs the shaking to be activated, thereby risking tossing the token off the bridge and requiring it to go back to near the start of the game path. Another game from Milton Bradely is the "Back Off Buzzard" game, which utilizes a flying buzzard as the antagonist element. In this game, the buzzard swoops down to grab a player's token if the token happens to be positioned on the game board at a place where the buzzard can reach it. Once swooped up by the buzzard, the token is moved back to the start of the game. U.S. Pat. No. 4,938,481 to Goldfarb, et al. describes a game having an incrementally advancing catcher unit that moves on a game board path to catch the player's game piece on the path. In one configuration of this game, which is available as "Shark Attack!" from Milton Bradley, the catcher unit is a motorized shark and the game pieces are fish. The player rolls a dice to move the fish in an attempt to stay ahead of the shark so as to not be "eaten" by the shark. In each of the aforementioned games, the player moves along the game path in a relatively randomly selected (i.e., dice throw or spinner) manner and the movement or operation of the antagonist feature or component is initiated either randomly or routinely.

Although there are many question and answer or trivia-based games and games which utilize an antagonist element, there are few if any games that combine these features with random operation (i.e., not direct human controlled) of the antagonist element so as to present a game that is both entertaining and educational. The structure and rules that govern many existing board games which are based on a question and answer format are determined by various limiting factors, including the narrowness of scope in terms of subject matter that is based on a limited or general knowledge of a specific topic or subject matter in order to play. In addition, games of chance most often are informed only by the primacy of random probability in terms of luck or chance to determine how the game is won and not the player's knowledge of a given topic. The existing games having an antagonist feature or character primarily rely on chance with regard to whether the player will be negatively impacted by the feature/character. Generally, most such game formats are often structured to accommodate only a limited number of players in regards to optimal play.

What is needed, therefore, is a game that combines the educational benefits of a question and answer structure with the excitement associated with the unpredictability of games of chance that have an antagonist element which can prevent or undo the player's forward progress. More specifically, what is needed is such a game wherein the format is structured to accommodate a wide range of players, from a single player to a multiplicity of teams, and the subject matter can be easily adapted to suit the needs or desires of the players. The preferred game should have a format for being challenging and entertaining, as well as providing educational advantages which combines the challenges of testing a player's knowledge of a wide range of topics while providing the added challenge of overcoming obstacles through knowledge, skill and luck. The preferred game should be useful for the player to study and learn educational subjects based on his or her play of the game. The preferred game should be adaptable to a wide range of game formats, including a board game and an electronic game.

SUMMARY OF THE INVENTION

The educational question and answer escape game having an antagonist element of the present invention, provides the benefits and solves the problems identified above. That is to say, the present invention discloses a game that combines the features of intellectual challenge, antagonist element and chance to meet the entertainment and educational needs of a wide and diverse population of players. The game of the present invention provides a method of play that educates the players about one or more subjects by utilizing questions and answers directed to those subjects, which subjects or categories of subjects can be preselected by the players prior to the start of the game. The educational question and answer escape game of the present invention utilizes the element of chance to dictate the forward movement of the player's token along a specified game path, a question and answer or trivia-type feature to allow the player to take or attempt to take certain action in order to avoid being sent back to the beginning of the path by an antagonistic element, the movement of which is dictated by the element of chance. The educational question and answer escape game of the present invention is suitable for play by a small number of players or for a larger number of players, whether playing by oneself or in groups. In more particularity, the present game is adaptable for single play, individuals versus individuals or by a group, such as a business or charity organization, against another group. The game of the present invention is adaptable to a wide range of thematic premises and for use with either a narrow or wide category of questions for the question and answer component of the game.

In one general aspect, the question and answer escape game having an antagonist element comprises a specified game path set in a thematic context that includes an antagonist element which fits within the desired thematic context to provide an element of risk for the player as he or she progresses along the game path. Each player or group of players is represented by a game token which progresses along the interconnected path segments of the game path from the start to the end thereof. The antagonist element of the game, which is selected to be consistent with the thematic context of the game, is in competition with the players for control of the entire game path. As a player's token moves along the game path from one segment to another, in an amount that is determined by a chance mechanism, there is the risk that the antagonist element, which is also moving along the same game path, will cause the player to have to return his or her token to the start position on the path. A portion of each segment of the game path is demarcated as a safety zone that avoids the danger of the moving antagonist element, the amount and direction of which movement is the result of random selection from a chance mechanism. Once a player lands on one of the game path segments, at which time he or she is in immediate danger, the player can choose to move his or her token to the safety zone of that segment by correctly responding to a question selected from one or more categories of questions or by operation of another chance mechanism. The first player to traverse the entire game path wins the game. The antagonist element prevents forward movement along the game path, by sending the player's token back to the start segment, when it passes or lands on a segment occupied by a player's token that is not in the safety zone of that segment. Preferably, the antagonist element starts toward the end of the game path and, initially, moves in a direction opposite that of the tokens. Later movement of the antagonist element can be in either direction along the game path in an amount determined by the random selection from a chance element or to one of a plurality of specifically designated location indicia on the game path, the determination of which segment is also chosen by chance, thereby making it nearly impossible to predict the future movement of the antagonist element. The location indicia can include named locations and colors on certain path segments. In addition to designated segments, the game path can also include one or more movement control segments where the movement of a player's token is either enhanced or restricted.

In one narrower aspect of the question and answer escape game of the present invention, the thematic context of the game is that it is set within an apocalyptic vision of the future on a generally S-shaped street in a mythical city populated by at least one mutant rat, as the game path and antagonist element, respectively. The game tokens represent people that inhabit the mythical city who are trying to move along the street, which is broken into a plurality of interconnected path segments, from the start space to safety at the end space. The first player to reach the safety of the end position wins the game. The portion of the path segments that is demarcated as a safety zone represents a building ledge that is "removed" from the exposed center section so as to be safe from the marauding mutant rat that is attempting to claim the street as its own. Certain of the path segments are specifically designated with street names or other location identifiers, such as colors. The rat, as the antagonist element, moves according to the operation of a specially configured chance mechanism, preferably a spinning wheel-type device, that results in random movement of the rat. The player tokens move according to the roll of dice. If the rat passes by or lands on a path segment occupied by a player's token that is on the exposed center section, as opposed to the safe ledge, then the player must move his or her token to the start position of the game path. During their turn, a player can move his or her token from the exposed center section to the safe ledge section by correctly answering a question on a card drawn from one of one or more sets of cards, preferably each directed to a somewhat different subject matter (although they may all be related to a single topic, such as science, mathematics or law), or by operation of a chance mechanism that is specifically configured for use to determine whether movement to the ledge should be allowed. One or more of other street segments are designated as movement control segments, such as a "no spin zone" where the option of using the chance mechanism to move to the ledge is removed, requiring the player to answer questions in order to place his or her token on the ledge. A timer is provided to limit the amount of time allowed for the player to answer the questions.

One of the benefits of the game of the present invention is the wide diversity of intellectual challenges that can be met through the question and answer format of the game. In addition, the game can be configured according to the specific interests of the players by adapting questionnaire cards that correspond to both the topic and level of difficulty as chosen by the players. The game is also suitable for solitary play, small group play and play by one or more teams of players.

Accordingly, the primary objective of the present invention is to provide a new educational question and answer escape game having an antagonist element that provides the advantages discussed above and overcomes the disadvantages and limitations which are associated with presently available games.

An important objective of the present invention is to provide a new educational question and answer escape game wherein the educational benefits of a question and answer format are combined with the challenges of luck to provide a game format that is both exciting and intellectually stimulating.

It is also an important objective of the present invention to provide a new educational question and answer escape game wherein the combines knowledge requirements of a question and answer format with an antagonist element that moves along the game path to cause players to have to go back to the start of the game.

It is also an important objective of the present invention to provide a new educational question and answer escape game in which the structure of play is flexible enough to fit the needs of a wide category of players according to their age, specific subject interests as well as educational or entertainment goals and to be adaptable for individual or group competitive play and for solitary study of any subject matter.

It is also an important objective of the present invention to provide a new educational question and answer escape game that can involve a wide range of players from a single solitary player to multi-team tournament play comprising a game board with moveable tokens that can be assigned to a single player or to a multiplicity of teams.

It is also an important objective of the present invention to provide a new educational question and answer escape game that is adaptable to various thematic contexts and where chance and random probability is combined with the player's knowledge of a given subject matter or topic to determine the outcome of the game.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment and represent one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For purposes of this disclosure, references are generally made to the use of the present invention as a board game played on typical game board surface. However, those skilled in the art will readily understand that the disclosure of the present invention will apply to other types of gaming devices, such as electronic games, that are configured to utilize the advantages and objectives of the present invention.

Figure 1:
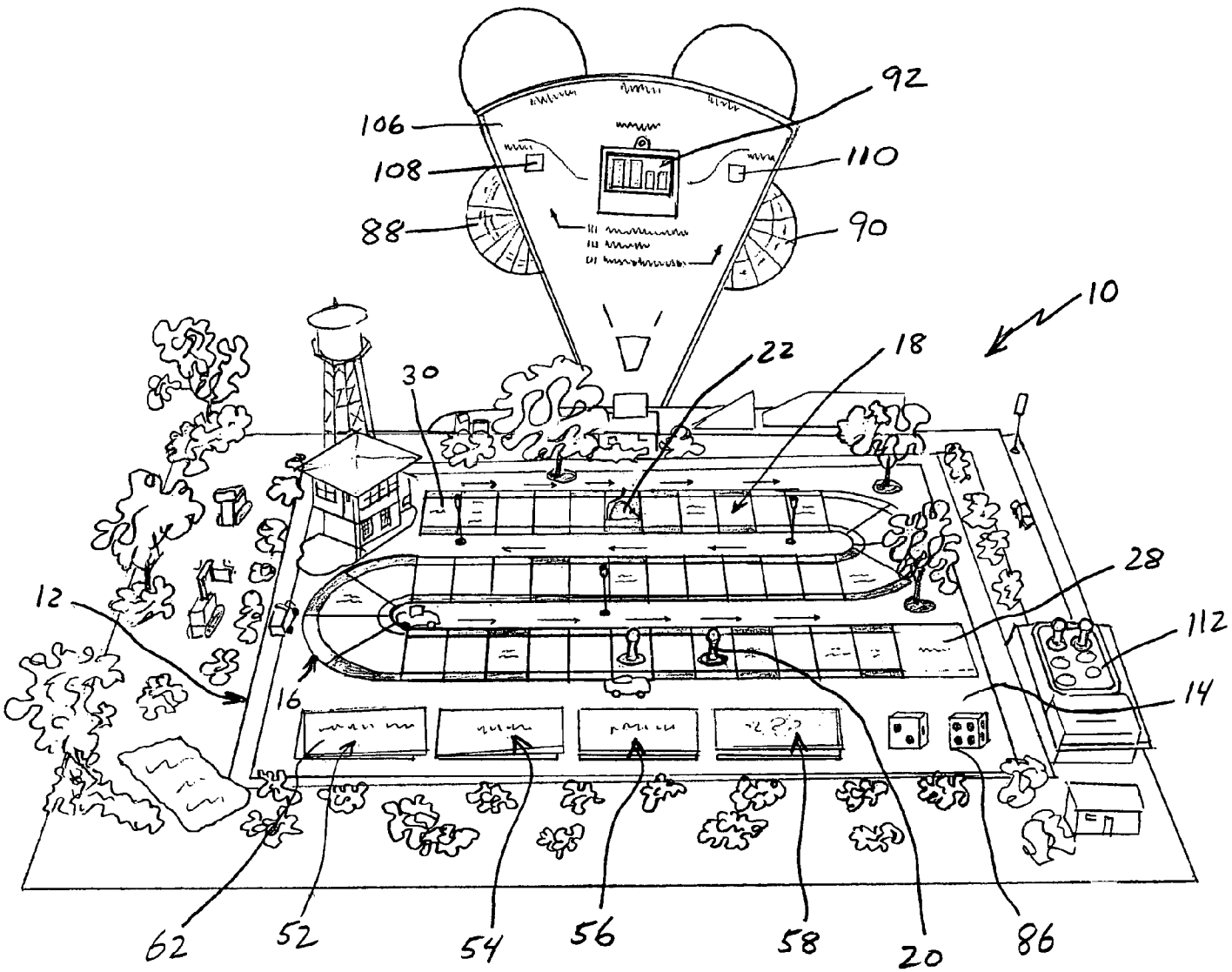
FIG. 1 is a top perspective view of a preferred embodiment of the question and answer escape game of the present invention showing the game board incorporated into a three-dimensional game layout, including a stand member having the timer, rat attack wheel and ledge wheel, with a rat as the antagonist element.
Figure 2:
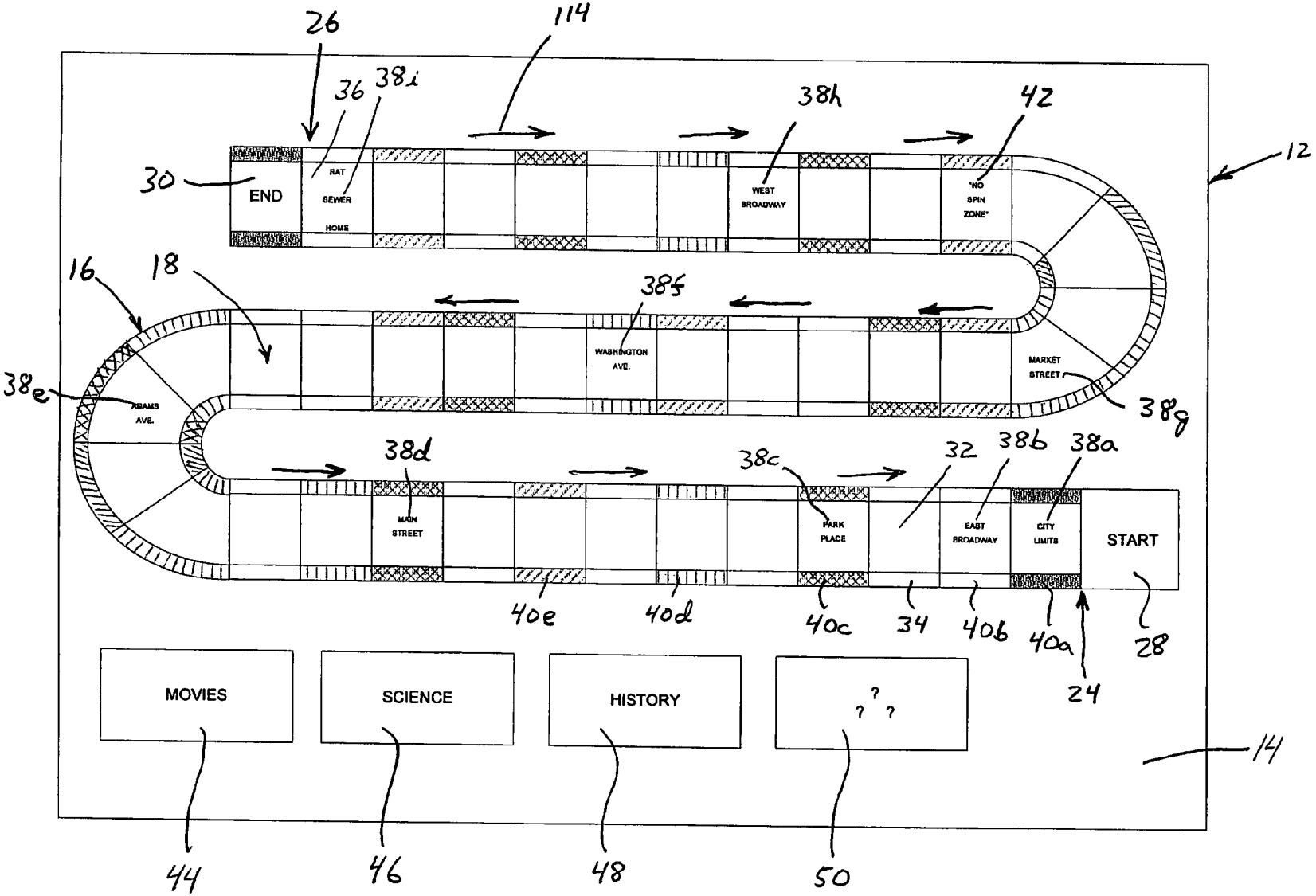
FIG. 2 is an isolated top view of the game board of FIG. 1.

An educational question and answer escape game having an antagonist element that is manufactured out of the components and configured pursuant to a preferred embodiment of the present invention is shown generally as 10 in the figures. As shown in FIGS. 1 and 2, in a preferred embodiment game 10 is configured as a board game that is played on game board 12 having an upper or playing surface 14 configured with the attributes necessary to play the present game 10. As discussed above, the present game 10 is adaptable to a wide variety of different thematic arrangements, from which the various components and play of the present game 10 are adapted to correspond. Although not necessary to play or understand the game 10 of the present invention, setting forth an example thematic context will provide a foundation for explaining the principles and configuration of the present game 10

In the embodiment shown in the figures and described herein, the thematic context is based on an apocalyptic vision of the future, wherein the game board 12 is provided with a S-shaped game path 16 representing a winding street made up of individual, interconnected path segments 18. The game 10 can be provided with a particular theme that is incorporated into game board 12 or game board 12 can be more generic with the theme set by one or more of the participants prior to the start of play. The basic theme is that the players, as represented by their respective playing tokens 20, travel along game path 16 and attempt to avoid being penalized by an antagonist element 22, as shown on the set-up of FIG. 1. As will be understood by those skilled in the art, game 10 of the present invention can be provided as a standard game board, such as game board 12 on FIG. 2, or it can be provided with game board 12 incorporated into a theme-based arrangement, such as that shown in FIG. 1.

As a specific example of one possible arrangement, thematic context of game 10 set forth in the embodiment described herein is that it has been ten or so years since a great nuclear war and all that remains are diseased animals searching for food and small groups of humans that live in the ruins of the cities. During the day, the human survivors wonder the city streets and surrounding areas searching for old super markets and the like that, although partially destroyed, are known to be depositories for uncontaminated food and water. In addition to the inherent dangers of digging through ruins of a contaminated city, the survivors face a new threat, the appearance of large, man-eating rats (the antagonist element 22) that have emerged from the sewers beneath the city streets. These large, mutant creatures are on a vicious rampage attacking everything in sight. The inhabitants of this city, named "Sewer City," only have once chance to survive—they must leave the city. Unfortunately, this requires them to avoid the mutant rats while they travel the street to leave the city. Thus, in the embodiment shown in the figures, the thematic context is based on an apocalyptic vision of the future, wherein the game board represents a street having safety ledges and the course of play is built around the concept of escaping the city.

The game path or street 16 has a first end 24 and a second end 26 at which are located start space 28 and end space 30, respectively, as best shown in FIG. 2. As described in more detail below, the goal of game 10 is for each player to progress from the start space 28 to the end space 30, which in the thematic context of the present game, is to reach safety by traveling on street 16 to escape the city. In a preferred embodiment, each path segment 18 comprises center section 32 and ledge 34. In an alternative embodiment, as a way to decrease the availability of safety zones, some of the path segments 18 may not include ledge 32, thereby eliminating a safe place at that path segment 18. As will be explained in more detail below, the interconnected centers 32 of the interconnected path segments 18 form the actual travel portion of street 16 and the corresponding ledges 34 of each path segment 18 is a safety zone to avoid being impacted by the antagonist element 22 (i.e., eaten by the rat). At second end 26 of game path 16 is located antagonist home space 36 where antagonist element 22 starts at the beginning of play of game 10. Generally, antagonist home space 36 will be designated with indicia indicating that this is its "home" location and with a description that is fitting for the thematic context of game 10. For instance, game path 16 shown in FIGS. 1 and 2 includes the words "Rat Home" to indicate that this is the starting place of rat 22 and "Sewer" on antagonist start space 36 to provide the appropriate thematic context (i.e., rat 22 lives in and leaves from the sewer). As is readily understood, other indicia or descriptions will be appropriate for other thematic elements.

As those skilled in the art will recognize, the shape of game path 16 that defines the playing course of game 10 can take on an infinite array of shapes (i.e., not S-shaped) and have a wide variety of place markers or names that are consistent with a thematically-based board game. To increase the thematic context of the question and answer escape game 10 of the present invention, game board 12 can be configured to more imitate an actual street or city by including landscaping, buildings, towers, and representations of a street and curb configuration with such elements as paving, manhole covers, drain grates, and etc., as shown in FIG. 1. In addition, ledges 34 can be raised above center section 32, representing the paved portion of the street surface, of each path segment 18 of game path 16, thereby more clearly delineating the difference between being on the dangerous center section 32 and the safety of ledges 34. As will be further recognized by those skilled in the art, game board 12 can be configured in a variety of forms, including laminated wood, cardboard, plastic or other materials which have been found to be suitable for a game board. In addition, game board 12 can be configured to be folded for convenient storage and/or portability. Alternatively, the question and answer escape game 10 of the present invention can also be configured for use with various electronic gaming platforms, including personal computers, the Internet, game consoles and/or handheld devices.

As best shown in FIG. 2, game path 16 also includes one or more named location indicia, referenced collectively herein as 38, but shown individually as "City Limits" 38*a*, "East Broadway" 38*b*, "Park Place" 38*c*, "Main Street" 38*d*, "Adams Ave." 38*e*, "Washington Ave." 38*f*, "Market Street" 38*g*, "West Broadway" 38*h* and "Sewer" 38*i*. Game path 16 also includes one or more colored location indicia, referenced collectively herein as 40, including first color 40*a*, second color 40*b*, third color 40*c*, fourth color 40*d* and fifth color 40*e*. In one embodiment, first color 40*a* is blue, second color 40*b* is white, third color 40*c* is purple, fourth color 40*d* is orange and fifth color 40*e* is yellow. For purposes of the present disclosure, the above colors on game board 12 are designated by background patterns. In the embodiment shown in the figures, the named location indicia are placed in center section 32 and the colored location indicia 40 are placed in ledges 34. As will be readily understood by those skilled in the art, game 10 of the present invention is not so limited. More or less named location indicia 38 and/or colored indicia 40 can be utilized on game path 16 and the named location indicia can be placed at path segments other than those shown. In addition, game 10 of the present invention is not limited to positioning the named location indicia 38 at center section 32 or colored location indicia 40 at ledges 34, as these may be reversed and/or mixed. In addition, various background markings or other forms of separately identifying one path segment 18 from another can be utilized (such as cross-hatching, symbols and the like). As is explained in more detail below, the individual named location indicia 38 and colored location indicia 40 are placed on game board 12 at different locations thereon to direct a player's token 20 or antagonist element (rat) 22 thereto.

In the preferred embodiment, game path 16 also includes one or more path segments 18 having a movement control indicia 42 thereon. In the embodiment shown in FIGS. 1 and 2, game path 16 includes "No Spin Zone" as the movement control indicia 42, located on the last stretch of game path 16 towards the second end 26. The purpose of movement control indicia 42 is to control the movement of one or more player tokens 20 when the token 20 lands on or passes by movement control indicia 42. In the preferred embodiment of the present invention, the "No Spin Zone" movement control indicia 42 has the purpose of eliminating one of the methods in which the player can move his or her token 20 onto the safety of ledge 34 so as to avoid the wrath of antagonist element 22. Other types of movement control indicia 42 can also be utilized. For instance, one or more "Lose Turn" or "Go Back To Start" commands can be utilized for movement control indicia 42 at one or more locations on game path 16. As will be readily understood by those skilled in the art, game 10 of the present invention is not limited to the movement control indicia 42 set forth in the above identified examples.

As shown in FIGS. 1 and 2, game board 12 also comprises one or more designated card spaces, such as first card space 44, second card space 46, third card space 48 and fourth card space 50, on each of which is placed a card set, shown as first card set 52, second card set 54, third card set 56 and fourth card set 58, respectively. The question cards, referenced herein collectively as 60, in each card set provide the questions for the question and answer aspect of game 10. In a preferred embodiment of game 10 of the present invention, each card set comprises fifty to one hundred cards. As those skilled in the art readily appreciate, the categories of subject matter for the various card sets 52, 54, 56 and 58 is virtually infinite, as well as the number of reference cards 60 and the scope of the questions contained thereon. As way of example and not intended to limit the present invention, game board 12 of FIGS. 1 and 2 utilizes the category "Movies" for first card set 52 on first card space 44, the category "Science" for second card set 54 on second card space 46, the category "History" for third card set 56 on third card space 48 and a mystery category, shown as "? ? ?", for fourth card set 58 on fourth card space 50. As with many board games, the card spaces 44, 46, 48 and 50 may be blank or have a category description printed therein (as shown). Likewise, as with many other card draw games, the top side 62 of the cards 60 can be blank, have the name of the game or a category description thereon and the bottom side 64 will have the question, answer and instructions thereon, as shown in FIG. 3.

Figure 3:
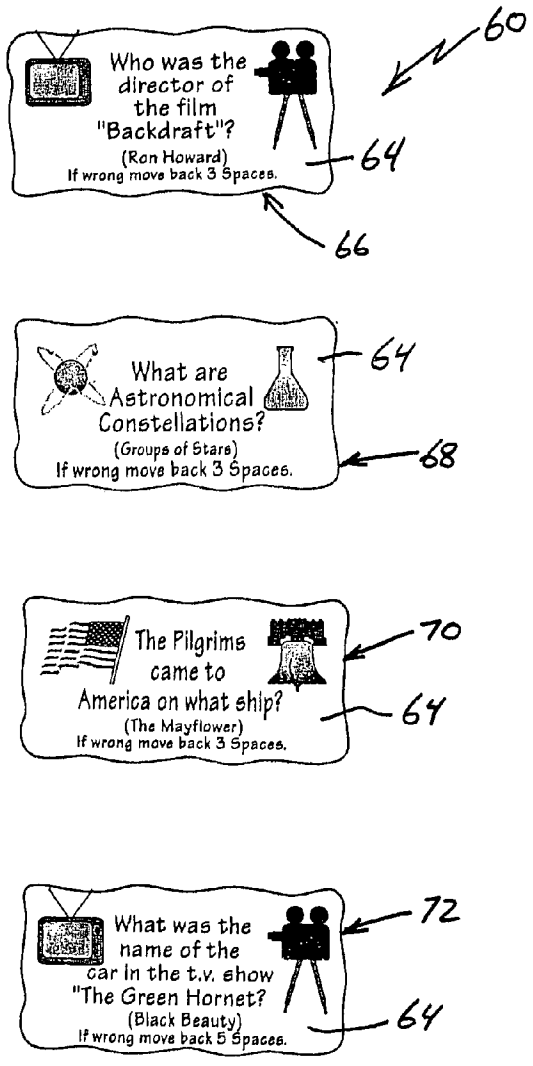
FIG. 3 is a bottom view of exemplary question cards for use with the game of FIG. 1.

In the embodiment shown in the figures, and exemplified in FIG. 3, first set of cards 52 comprises a plurality of movie cards 66 that seek answers to questions about movies and the like. Second set of cards 54 comprises a plurality of science cards 68 that seek answers to questions about various science-related topics. Third set of cards 56 comprises a plurality of history cards 70 that seek answers to questions about various history-related topics. Fourth set of cards 58 comprises a plurality of mystery cards 72 that seek answers to a variety of questions, such as the television question shown in FIG. 3. The questions on mystery cards 72 can be random unrelated questions (i.e., not related to each other and/or the other categories), various questions from the other three categories or a combination of random questions and questions from the other categories. As shown in FIG. 3, the bottom side 64 of cards 60 of the present embodiment contains the question, the corresponding correct answer and the penalty for the wrong answer (i.e., move a certain number of spaces back towards start space 28). The penalty for the wrong answer can be a pre-set number of moves backward, loss of a turn, return to start space 28 or a variety of other game appropriate penalties.

Although the embodiment of the present invention shown in the figures and discussed herein shows the question cards 60 as corresponding to the categories that are shown in FIGS. 1 and 2, those skilled in the art will readily understand that the categories for the topics addressed by question cards 60 can correspond to any subject area as determined by the interests or study needs of the players. Additionally, if desired, the topics of question cards 60 can also be categorized by the knowledge-level of the players. For example, the second set 54 of question cards 60 of the present invention, which are directed to questions on the topics of science, can comprise questions and answers regarding concepts or problems at the elementary school level that are appropriate for children or questions and answers regarding concepts or problems at more advanced levels of science for college students, depending on the target players for game 10.

Figure 4:
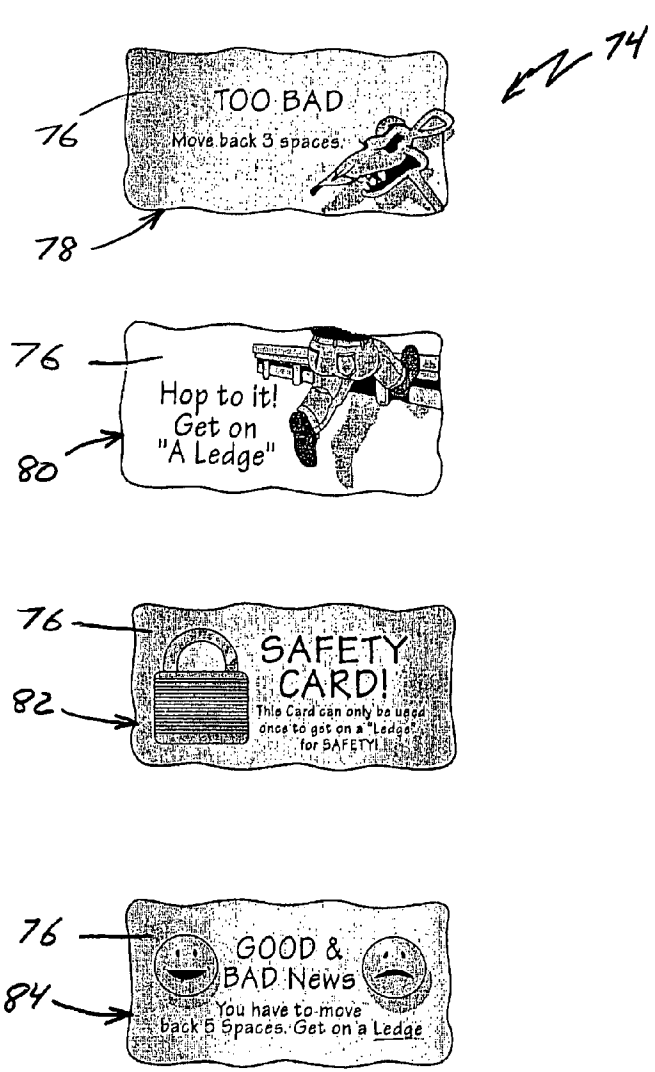
FIG. 4 is a bottom view of exemplary action cards for use with the game of FIG. 1.

In the preferred embodiment of the present invention, game 10 also includes one or more, preferably a plurality, of action cards 74 mixed in with question cards 60. An example of some action cards are set forth in FIG. 4. The top side, not shown, of action cards 74 will match the top side 62 of question cards 60 to be mixed in the appropriate set of cards (i.e., first 52, second 54, third 56 or fourth 58 set of cards). The bottom side 76 of action cards 74 will have action directions for the player, as opposed to the questions and answers of question cards 60. In the preferred embodiment, action cards 74 comprise both negative and positive, as well as some that are mixed negative/positive action requirements. As an example, first action card 78 requires the player to move his or her token 20 back three spaces. Second action card 80 directs the player to move his or her token 20 to the safety of ledge 34.

Third action card 82 is a "Safety Card" that the player can hold onto for use later when he or she believes it is more imperative to move to the ledge 34 to avoid the rat 22. Fourth action card 84 is an example of a mixed requirement, namely the player must move his or her token 20 back five spaces but he or she also gets to move their token 20 to ledge 34 at that new position. A nearly unlimited variety of other types of action requirements are also suitable for action cards 74.

Those skilled in the art will readily understand that question cards 60 and action cards 74 can be configured from many different materials and sizes, including laminated cardboard sized as traditional playing cards or smaller-sized decks for improved portability. Additionally, question cards 60 and action cards 74 can be printed in large print or in Braille to accommodate the needs of the visually impaired. As also known by those skilled in the art of game development, game 10 of the present invention can be configured as a computer or electronic format wherein the question cards 60 and action cards 74 are configured as subject categories to be accessed through the screen and/or keyboard, or by other appropriate technological mechanism.

In a preferred embodiment of the present invention, as described above, the system for game 10 has a plurality of game pieces, including rat 22 as the antagonist element (shown in FIG. 1) and one or more tokens 20 to represent the individual player or groups of players. Antagonist element 22 can be configured in any desired type of animal or other character. For instance, antagonist element 22 can be a wolf, lion, gangster, terrorist or alien. While there are benefits to providing a generic looking component for antagonist element 22, namely that the component can then be any type of animal or character, it is preferred that the antagonist element 22 be an actual "bad" animal or character so as to add more interest and excitement to game 10. Likewise, as is well known, game tokens 20 can be configured as a basic token-like component of various contrasting colors or it can consist of plastic game figures that are configured into upright human forms to add a degree of realism to game 10. In general, game tokens 20 can be configured into any shape or color to correspond to individual players or, for tournament play, as representations of teams. Further, as known by those skilled in the art, in terms of electronic and/or computerized play, game tokens 20 can be configured as animated characters. Alternatively, game tokens 20 and antagonist element 22 can be configured as specifically colored lights that light up as the token 20 or antagonist element moves along playing path 16 of game 10.

Figure 6:
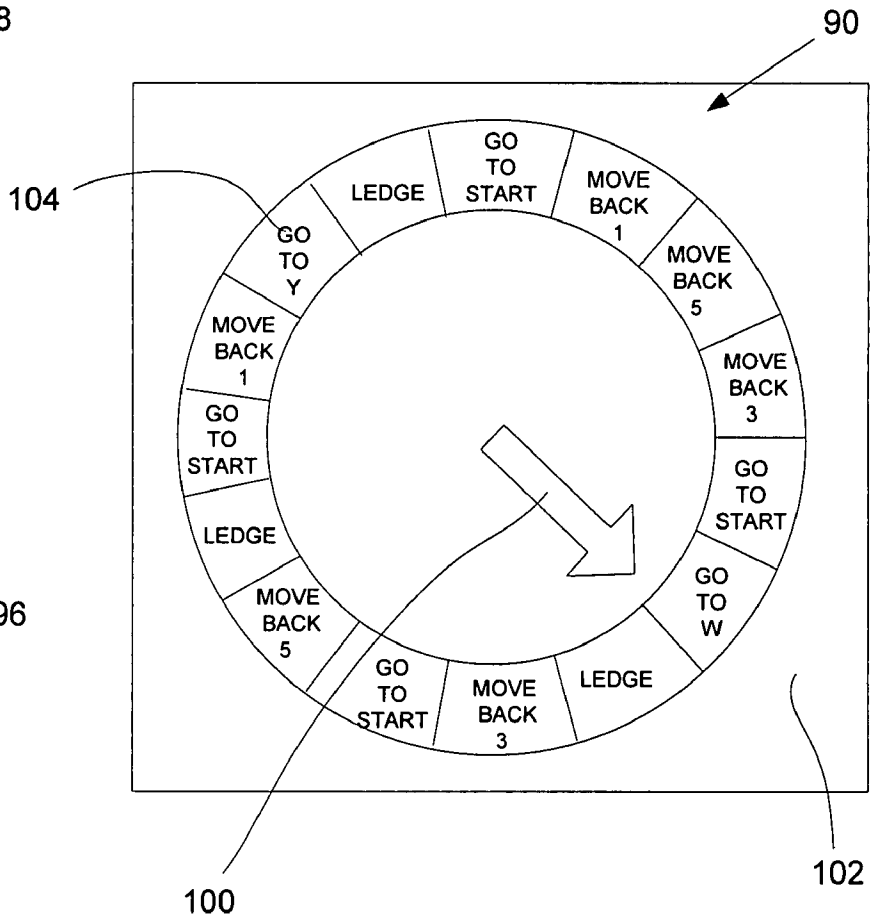
FIG. 6 is a top view of an ledge wheel for use with the game of the present invention to determine if a user can move his or her token to the ledge of a path segment to avoid the antagonist element.
Figure 5:
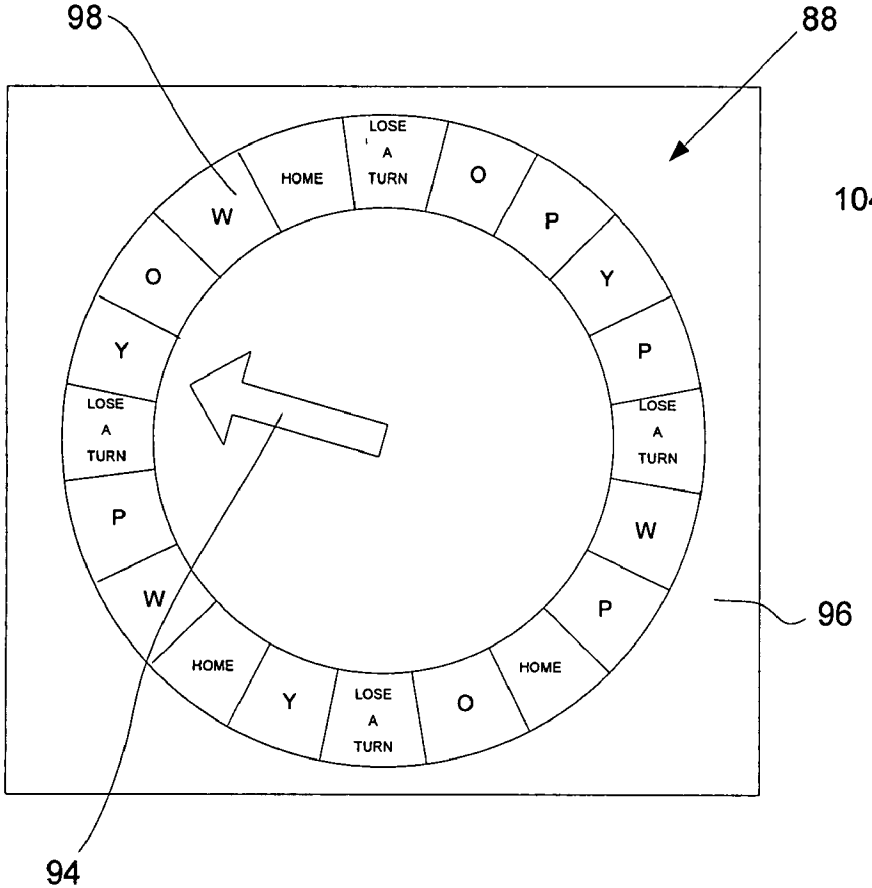
FIG. 5 is a top view of an antagonist attack wheel for use with the game of the present invention to control the movement of the antagonist element (i.e., the rat) and restriction or benefit to the player.

The preferred embodiment of game 10 of the present invention also includes one or more chance mechanism, such as one or more dice 86, antagonist attack wheel 88 and ledge wheel 90, and a timer mechanism 92, as shown in FIGS. 1, 5 and 6. As explained in more detail below, dice 86 are used to determine the order of play at the beginning of game play and are used to determine how many path segments 18 a player's token 20 advances when it is his or her turn. Antagonist attack wheel 88, or in the embodiment shown the "rat attack wheel," is utilized to randomly determine the movement of antagonist element (rat) 22 on game path 18 or, depending on where the arrow falls, to determine the fate of the player(s). Ledge wheel 90 is utilized as one method of determining whether the player can move his or her token 20 from center section 32 of path segment 18 or on to the safety of ledge 34. In one configuration of a preferred embodiment of the present invention, antagonist attack wheel 88, as shown in FIG. 5, comprises a spinning pointer arrow 94 that spins on base 96 to point to one of the plurality of wheel segments 98 to direct the movement of antagonist element 22 on game path 18. Wheel segments 98 include directions such as "Home" to direct the antagonist element 22 back to antagonist start place 36, colored spaces corresponding to the interior colored location indicia 40 (i.e., not first color 40*a*) and "Lose a Turn" to inform the player that he or she loses a turn. In the configuration shown in FIG. 6, ledge wheel 90 comprises a spinning pointer arrow 100 that spins on base 102 to point to one of the plurality of wheel segments 104 to direct the player's token 20 when he or she desires to get to ledge 34. As shown, wheel segments 104 include instructions such as "Go to Start" directing the player to move his or her token back to the start space 28 and "Ledge" directing the player to move his or her token to the ledge 34 in his or her presently occupied path segment 18. Wheel segments 104 also include instructions directing the player to move his or her token 20 either back a specified number of spaces (i.e., one, three or five path segments 18) or to the nearest specific colored location indicia, such as the second color (white) or the fifth color (yellow). Depending on the location of the player's token 20 when he or she spins ledge wheel 90, this could move token 20 forward toward end space 30 or backward towards start space 28. The construction and use of such a spinner wheel as antagonist attack wheel 88 and/or ledge wheel 90 is well known to those skilled in the art. As also is well known, other combinations of instructions, directions and penalties can be incorporated into antagonist attack wheel 88 and/or ledge wheel 90. In addition, as further well known, devices other than a spinning wheel can be utilized to randomly provide an output that directs the player's action.

In the preferred embodiment of the game 10 of the present invention, a timer mechanism 92 is utilized to limit the amount of time allowed for a player to respond to a question asked in response to drawing a question card 60 from either of first 52, second 54, third 56 or fourth 58 set of cards. In one preferred embodiment, timer mechanism 92 is a typical hourglass sand timer. In the preferred embodiment, such as shown in FIG. 1, timer mechanism 92 is an electronic timer that electronically displays the time. If desired, an electronic timer mechanism 92 can include an audible and/or visual signal to signify that the time for answering the question has expired. As also shown in FIG. 1, which incorporates game board 12 into a three dimensional game layout, timer mechanism 92 can be incorporated into a stand member 106, which is shaped generally like a rat's head in one embodiment of the present invention. Antagonist attack wheel 88 and ledge wheel 90 are also incorporated into stand member 106, with each having a small window-like opening, shown as 108 and 110 respectively, for displaying the "selected" wheel segment 98 or 104. In such a configuration, the openings 108 and 110 replace the pointer arrows 94 and 100 respectively. The three dimensional layout shown in FIG. 1, also includes a token stand 112 for storing tokens 20 that are not in use and various architectural and landscaping elements to enhance the player's use of game 10.

At the commencement of play of the question and answer escape game 10 of the present invention, game board 12 is placed on an appropriate support surface with playing surface 14 facing upward. Each player or team of players roll one of the dice 86 to determine which player or team of players gets to go first (i.e., highest number goes first). If desired, the players then can arrange their seating to reflect the order of the play determined by the above throw of the dice 86 and choose their token 20 based on the order of play. Each player's token 20 is placed at start space 28 to begin play of game 20. In a preferred embodiment, the player who will go first also has the option of starting the game 10 by setting a thematic context, such as the theme described above with the mutant rat as the antagonistic element 22. Alternatively, the thematic context of game 10 can be pre-arranged by the players or incorporated into game 10 itself before play of game 10. The antagonist element 22 is placed at the antagonist start space 36, the question cards 60, randomly mixed with action cards 74, are placed on their appropriate card spaces (i.e., first 44, second 46, third 48 and fourth 50) and, if necessary, the antagonist attack wheel 88, ledge wheel 90 and timer 92 are set-up or otherwise arranged.

Each player's turn involves three separate steps. First, the player starts his or her turn by spinning the antagonist attack wheel 88 to move antagonist element (rat) 22. Second, the player rolls dice 86 to determine the amount he or she moves his or her token 20 from the center section 32 of one path segment 18 to the center section 32 of another path segment 18. Third, the player chooses whether to attempt to move his or her token 20 from center section 32 to ledge 34 so as to seek safety from the next move of antagonist element 22. As set forth above, the goal of game 10 is for each player to try to be the first to have his or her token 20 move through game path 16 to the end space 30. Naturally, this is best accomplished by progressing as quickly as possible along game path 16 while, to the extent possible, avoiding being impacted by the antagonist element 22.

In the first step of a player's turn, in which the player spins or otherwise operates the antagonist attack wheel 88, if the operation thereof results in a color, the player moves antagonist element 22 to the center section 32 of the nearest path segment 18 having that colored location indicia 40. If antagonist element 22 is equally spaced between two path segments 18 of the same colored location indicia 40, then the player moves the antagonist element 22 to the nearest path segment having the colored location indica 40 in the direction of travel indicated by directional arrows 114 marked on game board 12. If "Lose a Turn" is shown, then the player loses his or her turn. If a named location indicia 38 is shown, then the player moves antagonist element 22 to the center section 32 of the path segment 18 having that named location indicia 38. If "Home" is shown by the attack wheel 88, then the player moves antagonist element 22 to the antagonist start space 36, if it is not already there. During play of game 10, the movement of antagonist element 22 can result in one or more player tokens 20 being sent back to the start space 28 as a penalty (i.e., being eaten by rat 22). In a preferred embodiment, if during its movement antagonist element 22 passes by or lands on a path segment 18 where the center section 32 is occupied by a player's token 20, then that token is sent back to start space 28. If the player's token 20 is on the ledge 34 of the path segment 18 which the antagonist element 22 passes or lands, the player is safe from being impacted (i.e., eaten) by the antagonist element 22 and, therefore, remains where he or she is located. If the player's token 20 is eaten when it is his or her turn, then he or she must move the token 20 back to start space 28 and then roll dice 86 to begin his or her turn. If the player's token 20 is eaten before it is his or her turn, then the token 20 is moved back to start space 28 and the player begins his or her turn, when appropriate, from that location.

In the second step of a player's turn, the player rolls dice 86 to determine the amount he or she moves his or her token 20 from one path segment 18 to another. In the preferred embodiment of game 10 of the present invention, the tokens 20 only move along the center sections 32 of path segments 18 that forms the actual street of game path 16. Normally, the player moves his or her token 20 the number of spaces indicated by the throw of dice 86 to the center section 32 of the appropriate path segment 18. If desired, benefits could be provided for certain roll combinations. For instance, if the player rolls a pair, then he or she could have a second roll or if he or she rolls a pair of ones ("snake eyes"), then the rules could direct the token 20 to the ledge 34 of the appropriate path segment. As is readily understood by those skilled in the art, various other play combinations can be utilized and a variety of different chance mechanisms, other than dice 86, can be utilized to determine how far the player moves his or her token 20.

In the third step of a player's turn, the player must first decide if he or she wants to attempt to move their token 20 from the center section 32 of the occupied path segment 18 to the safety of ledge 34 thereof so as to avoid the movement of antagonist element 22. If the player does not want to make such an attempt, then the player so indicates and his or her turn is over, allowing the next player to take his or her turn. If the player does want to attempt to move token 20 to ledge 34, then the player has two options to consider, namely he or she must choose whether to utilize the question cards 60 or ledge wheel 90. If the player chooses to answer a question, the player or one of the other players selects a card (which could be a question card 60 or action card 74) from one of first 52, second 54, third 56 or fourth 58 sets of cards. The rules of game 10 could allow either the player whose turn it is to choose the category or allow other players to make that choice. If the chosen card is a question card 60 and the player answers the question correctly, then his or her token 20 is moved to ledge 34. If the question is not answered correctly, then the player follows the instructions from the question card 60 and move his or her token 20 accordingly. If the chosen card is an action card, then the player moves his or her token 20 accordingly, which may be to ledge 34, back a number of path segments 18, back to start space 28 or other directions. If the action card 74 is a "Safety Card," the player can use it then or save it for use at a later time during play of game 10. Such "Safety Cards" may, however, only be used once and only during a player's turn to move his or her token 20 to ledge 34. In the preferred embodiment, timer 92 is used to limit the amount of time the player has to correctly answer the question. The length of time for answering the question can be adjusted for individual, or non-team, play versus team play. For instance, in non-team play timer 92 can be set to require an answer in fifteen seconds and for team play timer 92 can be set for thirty seconds. Once the player has followed the instructions on question card 60 or action card 74, then his or her turn is over and the next player takes a turn.

If in making the ledge movement decision, the player chooses to utilize the ledge wheel 90 instead of the question cards 60, then he or she spins or otherwise operates ledge wheel 90 to see what action it indicates. If ledge wheel 90 displays the word "Ledge," then the player moves his or her token 20 to the ledge 34 of the path segment 18 he or she occupies. If ledge wheel 90 indicates a color, then the player must move his or her token 20 to the closest colored location indicia 40 indicated, which could be forward or backward, and place his or her token 20 on the ledge 34 thereof. As with the movement of the antagonist element 22, if the token 20 is equally spaced between the indicated colored location indicia 40, then the player must move his or her token 20 in the direction indicated by directional arrows 114. If the ledge wheel 90 indicates "Go To Start," then the player must move his or her token 20 to start space 28. If the ledge wheel 90 instructs the player to move the token 20 back a specified number of spaces, then he or she moves token 20 back to the appropriate path segment 18 and places his or her token 20 on the center section 32 thereof. In alternative embodiments of ledge wheel 90, other directions can be utilized. For instance, the word "Stay" can be included to indicate that the player's token 20 must stay in the center section 32 of the path segment 18 he or she occupies. If the words "All but 1" are utilized, this can indicate that the player moves his or her token 20 to the ledge 34 of the path segment 18 and all other players must move their token 20 off the ledge 34 they occupy, if any.

In the preferred embodiment of game 10 of the present invention, each path segment 18 is shown with a center section 32 and pair of bordering ledges 34, however, the ledges 34 are considered jointly as one ledge 34 for each path segment 18 such that only one player's token 20 may occupy a ledge 34 at a given time. This rule may be modified to allow multiple tokens 20 to occupy a ledge 34 when greater numbers of players (or teams of players) are playing game 10. For instance, for four to six players or teams, then up to two tokens 20 can occupy a ledge 34 and for seven to ten players or teams, then up to three tokens 20 can occupy a ledge 34. If a player's token 20 lands on a path segment 18 where ledge 34 is occupied by another player's token 20, then the player whose turn it is can challenge the occupying player, in effect dueling with the other player, for the right to be on ledge 34 (i.e., bump the other player off of ledge 34). If more than one token 20 occupies the ledge 34, for when there are larger number of players, then the challenging player chooses which player to challenge. The challenged player whose token 20 is on ledge 34 chooses a card from one of the sets of cards 52, 54, 56 or 58, and reads the question from the question card 60 aloud to the challenging player. If the challenging player answers the question correctly, then he or she moves their token 20 to ledge 34 and the challenged player moves his or her token 20 off ledge 34 and back the number of path segments 18 indicated on card 60 or six path segments 18, whichever is greater, where that player's token 20 is left in the center section 32 of the appropriate path segment 18 (at risk of a moving antagonist element). If the challenging player's answer is incorrect, then the challenging player's token 20 moves back the number of path segments 18 indicated on card 60 or six path segments 18, whichever is greater, and leaves his or her token 20 in the center section 32 of the appropriate path segment 18, while the challenged player's token 20 remains on ledge 34. If the challenged player draws an action card 74 that is a "Ledge" or "Safety" card, then the challenger automatically wins the challenge and bumps the challenged player's token 20 off ledge 34 and back six path segments 18 to the center section 32 of the appropriate path section 18 and the challenging player moves his or her token 20 to the safety of ledge 34.

As set forth above, the preferred embodiment of game path 16 includes the movement control indicia 42 specified as "No Spin Zone". During play, once a player's token 20 lands on or passes the "No Spin Zone" movement control indicia 42 then he or she no longer has the option of spinning or otherwise operating ledge wheel 90 to move his or her token 20 to the safety of ledge 34. Instead, the only way in which the player can move his or her token 20 to ledge 34 is to draw a question card 60, or action card 74, and correctly answer the question on the bottom side 76 thereof.

During play of game 10, there will be times when antagonist element 22 will be blocking the forward progress of a player's token 20 by being located in a center section 32 of a path segment 18 within the number of moves indicated by the dice 86 or other player movement mechanism. In a preferred embodiment of the present game, the player has the option of staying where he or she is or jumping over antagonist element (rat) 22. In order to jump over antagonist element 22 and continue his or her move, the player must answer a question from one of the sets of cards 52, 54, 56 or 58, or spinning the ledge wheel 90. The question answering procedure for jumping over the antagonist element 22 involves moving the player's token 20 to the path segment 18 immediately in front of the antagonist element 22 and then asking for a question card 60. One of the other players reads the question from card 60 and the moving player attempts to answer the question correctly. If the player answers the question correctly, then he or she moves their token 20 over the antagonist element 22 and moves token 20 the remaining number of path segments 18 indicated by the dice 86. The player then has the option of moving his or her token 20 to ledge 34 of the path segment 18 where he or she lands, as set forth above. If the player does not answer the question correctly, the player must follow the directions on the question card 60 or, if it is an action card 74, stay where he or she is in front of the antagonist element and then wait for their next turn (no opportunity to move to ledge 34). The ledge wheel 90 spinning procedure for jumping over antagonist element 22 involves moving the player's token 20 to the path segment 18 immediately in front of the antagonist element 22 and then spinning ledge wheel 90. If the word "Ledge" is selected, then the player's token 20 jumps antagonist element 22 and continues moving the number of path segments 18 indicated on the thrown dice 86. The player then has the option of attempting to move to ledge 34 by the procedure identified above. If "Ledge" is not selected, then the player must move his or her token 20 according to the instructions selected on ledge wheel 90. If antagonist element 22 is at the first space past start space 28, which is identified as "City Limits" 38*a* in the embodiment shown in the figures, then he or she must either correctly answer a question or get "Ledge" from a spin of ledge wheel 90 before he or she can move. Because the player is at start space 28, he or she does not move backwards.

In a preferred embodiment, once one player is able to move his or her token 20 to the end space 30, that player wins the game 10 and the game 10 is over. In another embodiment, the remaining players can continue play to determine who comes in second, third and etc. As set forth herein, winning the game 10 of the present invention requires a combination of luck, regarding his or her own moves, the movement of antagonist element 22 and the draw of cards 60 and 74, and his or her knowledge of the given topics as addressed by the question cards 60.

As stated above, game 10 of the present invention is suitable for both solitary play, play by small (i.e., 3 to four players) groups and for team play by teams that can comprise any number of players. During solitary play, the player only needs to roll dice 86, spin antagonist attack wheel 88 and ledge wheel 90 to move his or her token along game path 16 while attempting to avoid the dangers of antagonist element 22. If desired, special question cards 60 and action cards 74 can be provided that do not have the question and answer on the same side of the card 60 or 74. Solitary play of game 10 is useful as a teaching or study tool. To facilitate the benefits of game 10 for such use, the player should utilize the question cards 60 as much as possible. In fact, it may be beneficial to modify the rules to require answering more questions. For team play, each team is considered a unit and plays game 10 as they would if they were individual players. Other than being allotted more time to answer the questions, the rules for team play are the same as set forth above for play by individual players. As with other team play types of games, it may be beneficial to designate someone as the captain or other leader of the team. To improve the excitement of game 10, a prize could be awarded to the winning team. Team play could be play between any two or more groups of people using question cards 60 that have questions which would be of particular interest to the people on the teams. For instance, one law firm could challenge one or more other law firms using questions that are based on legal codes, case law, statutes and other law-related topics. Many other types of team play and question categories are adaptable to game 10.

Although the description herein is primarily directed to use of game 10 as a board game, those skilled in the art of games will readily understand that it is not so limited. The advantages and objectives of game 10 of the present invention are easily adaptable to an electronic format for play on computers, the Internet, televisions, hand-held devices and other electronic media. As also stated above, game 10 is also not limited to the specific example set forth herein with regard to the thematic context, antagonist element 22, game board 12, game path 16, antagonist attack wheel 88, ledge wheel 90, type of chance mechanisms and other specific components.

While there are shown and described herein a specific form of the invention, it will be readily apparent to individuals skilled in the art that the invention is not so limited, but is susceptible to, various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. An educational question and answer escape game comprising:

a game path having a first end and a second end with a plurality of path segments disposed therebetween, a plurality of said path segments having a center section and a ledge;

a start space at said first end of said game path and an end space at said second end of said game path;

one or more location indicia on one or more of said path segments;

one or more player tokens;

an antagonist element;

one or more chance mechanisms, at least one of said one or more chance mechanisms having indicia thereon corresponding to one or more of said path segments to direct said antagonist element; and one or more card spaces on said game board, each of said one or more sets of questions comprising one or more categories of questions.

2. The game according to claim 1, wherein said game path is on a playing surface of a game board.

3. The game according to claim 2, wherein said game board has one or more card spaces thereon, each of said card spaces having one or more sets of cards comprising a plurality of question cards, each of said question cards having one of said sets of questions thereon.

4. The game according to claim 3, wherein said each of said one or more card spaces corresponds to one of said categories of questions.

5. The game according to claim 3, wherein said one or more sets of cards further comprises a plurality of action cards.

6. The game according to claim 1, wherein each of said path segments has said center section and said ledge.

7. The game according to claim 1, wherein said game path has a antagonist start space at said second end of said game path, said antagonist element at said antagonist start space at the commencement of said game.

8. The game according to claim 1, wherein said location indicia includes a plurality of named location indicia, each of said named location indicia being distinct.

9. The game according to claim 8, wherein said location indicia includes a plurality of colored location indicia.

10. The game according to claim 9, wherein each of said named location indicia are located at one of said center sections and said colored indicia are located at one or more of said ledges.

11. The game according to claim 1, wherein said game path has one or more movement control indicia on one or more of said path segments.

12. The game according to claim 1, wherein said one or more chance mechanisms comprise an antagonist attack mechanism and a ledge mechanism, said antagonist attack mechanism configured to determine the movement of said antagonist element on said game path, said ledge mechanism configured to determine the movement of said token from said center section to said ledge on said path segment.

13. An educational question and answer escape game comprising;

a game board having a playing surface with a plurality of interconnected path segments defining a game path having a first end and a second end, a plurality of said path segments having a center section and a ledge;

a start space at said first end of said game path and an end space at said second end of said game path;

one or more location indicia on one or more of said path segments;

one or more player tokens;

an antagonist element;

one or more chance mechanisms at least one of said one or more chance mechanisms having indicia thereon corresponding to one or more of said path segments to direct said antangonist element;

one or more sets of questions, each of said one or more sets of questions comprising one or more categories of questions;

an antagonist start space on said game path; and one or more card spaces on said game board, each of said card spaces having one or more sets of cards comprising a plurality of question cards, each of said question cards having one of said sets of questions thereon,

14. The game according to claim 13, wherein said each of said one or more card spaces corresponds to one of said categories of questions and each of said one or more sets of cards further comprises a plurality of action cards.

15. The game according to claim 13, wherein said game path further comprises one or more movement control indicia on one or more of said path segments.

16. The game according to claim 13, wherein said one or more chance mechanisms comprise an antagonist attack mechanism and a ledge mechanism, said antagonist attack mechanism configured to determine the movement of said antagonist element on said game path, said ledge mechanism configured to determine the movement of said token from said center section to said ledge on said path segment.

17. A method of playing an educational question and answer escape game for one or more players, said method comprising the steps of:

a. providing a game path having a start space at a first end, an end space at a second end and a plurality of interconnected path segments disposed therebetween, a plurality of said path segments having a center section and a ledge;

b. assigning each of said one or more players a token and placing each of said tokens at said start space;

c. placing an antagonist element at an antagonist start space at said second end of said game path;

d. operating a first chance mechanism to identify a first selected path segment for said antagonist element;

e. moving said antagonist element to said selected path segment identified said first chance mechanism;

f. operating a second chance mechanism by a first player assigned a first token to identify a second selected path segment for said first token;

g. moving said first token to said center section of said second selected path segment identified by said second chance mechanism;

h. choosing a question card from a plurality of said question cards in one or more sets of cards or operating a third chance mechanism to identify a token position for said first token, each of said question cards having a question thereon;

i. moving said first token to said ledge for a correct answer to said question on said question card, or as directed by said third chance mechanism, or leaving said first token at said center section for an incorrect answer to said question or as directed by said third chance mechanism.

j. repeating steps d and e to move said antagonist element; and k. moving any of said tokens at said center section of any path segment landed on or passed by said antagonist element during step j to said start position while allowing any of said tokens at said ledge of any path segment to remain in place.

18. The method according to claim 17, wherein one or more of said path segments have a location indicia thereon, said first chance mechanism having corresponding indicia thereon for movement of said antagonist element, said third chance mechanism having corresponding indicia thereon for movement of said first token.

19. The method according to claim 18, wherein said location indicia includes a plurality of named location indicia and a plurality of colored location indicia, each of said named location indicia being distinct.

20. The method according to claim 17, wherein said game path further comprises one or more movement control indicia on one or more of said path segments.

21. The method according to claim 17, wherein said ledge in step I is occupied by a second token assigned to a second player and only one of said tokens is allowed on said ledge at a time, step I further comprising the step of said first player offering a challenge to said second player in order to move said first token onto said ledge, removing said second token from said ledge if said challenge is successful and leaving said second token on said ledge if said challenge is not successful.

* * * * *